United States Patent [19]

Probst

[11] Patent Number: 4,459,345

[45] Date of Patent: Jul. 10, 1984

[54] STATIONARY AND MOVING MAGNETS FORMING A MAGNETIC BRUSH DEVELOPER APPARATUS AND METHOD

[75] Inventor: Stewart D. Probst, Rush, N.Y.

[73] Assignee: Eastman Kodak Company, Rochester, N.Y.

[21] Appl. No.: 499,637

[22] Filed: May 31, 1983

[51] Int. Cl.[3] ..... G03G 15/09

[52] U.S. Cl. ..... 430/122; 118/657; 118/658

[58] Field of Search ..... 355/3 DD; 118/657, 658; 430/122

[56] References Cited

U.S. PATENT DOCUMENTS 2,919,674 1/1960 Sih .
3,962,992 6/1976 Takagi et al. .
3,998,185 12/1976 Weiler .
4,114,261 9/1978 Weiler .
4,126,100 11/1978 Nishihama et al. .
4,171,900 10/1979 Brugger ..... 118/658

FOREIGN PATENT DOCUMENTS 2761978 4/1975 Japan .

*Primary Examiner*—John E. Kittle
*Assistant Examiner*—John L. Goodrow
*Attorney, Agent, or Firm*—Lawrence P. Kessler

[57] ABSTRACT

Magnetic brush developer apparatus which alleviates any developer material starvation in the area of contact with a charge pattern-bearing member. Such apparatus develops an electrostatic charge pattern on a member by contacting the member with developer material, including magnetic particles, transported toward and away from the charge pattern-bearing member by an applicator member. The transported developer material is magnetically agitated in the area of contact with the charge pattern-bearing member in a direction which includes at least a component perpendicular to the transport direction, whereby intermixing of the developer material in such contact area is substantially improved to reduce any propensity toward toner starvation and the developed image defects resulting from such starvation.

5 Claims, 4 Drawing Figures

STATIONARY AND MOVING MAGNETS FORMING A MAGNETIC BRUSH DEVELOPER APPARATUS AND METHOD

BACKGROUND OF THE INVENTION

This invention relates in general to magnetic brush developer apparatus and method for electrographic reproduction equipment, and more particularly to magnetic brush developer apparatus and method wherein a developer nap is magnetically agitated in a direction which substantially improves intermixing of the material in the nap and reduces any propensity toward toner starvation.

In the electrographic process for making reproductions of input information, an electrostatic charge pattern is formed on the surface of an insulating member in image-wise configuration corresponding to the information to be reproduced. The charge pattern is developed by applying developer material to such pattern to form a visible image. The visible developer material image is then either transferred to a receiver member and fixed to such member, or fixed to the insulating member itself. In commercial high speed electrographic reproduction equipment, a common mechanism for developing electrostatic charge patterns is a magnetic brush developer apparatus; see, for example, U.S. Pat. No. 3,703,395, issued Nov. 21, 1972 in the name of Drexler et al.

A typical magnetic brush developer apparatus includes one or more magnets located within an applicator member. The applicator member may rotate about fixed magnets, the magnets may rotate within a fixed applicator member, or both may rotate in the same or opposite directions. Developer material comprises, for example, a mixture of finely divided pigmented thermoplastic marking particles (toner) held to the surface of ferromagnetic particles (carrier) by electrostatic charges created by triboelectrification (see for example, U.S. Pat. No. 3,893,935, issued July 8, 1975 in the name of Jadwin et al). The carrier particles, with the attached toner particles, are held on the applicator member in a bristle-like formation by the magnetic fields of the magnets to form a brush nap. Alternatively, the developer material is of the type comprised solely of charged marking particles which also exhibit magnetic properties, referred to as single component developer (see for example, U.S. Pat. No. 4,171,274, issued Oct. 16, 1979, in the name of Schwarz et al). The developer material brush nap is moved into contact with the electrostatic charge pattern by brushing the nap bristles across the surface of the insulating member. When the developer material contacts the surface of the insulating member, the electrostatic attraction for the charged toner particles by the charge pattern on the insulating member overcomes the attraction of the carrier particles for the toner particles (or the magnetic attraction of the magnets within the applicator member for single component developer). Thus, the toner particles are transferred to the charge pattern and the pattern is developed.

Since the developer material is presented to the charge pattern only in the area of contact of the nap bristles and the insulating member, there is a limited amount of material in the bristles available at any given instant to carry out development. In most instances sufficient developer material is available for complete charge pattern development. However, when the insulating member is moving at a relatively high speed relative to nap bristles, or when the insulating member has a large area of dense charge patterns, there may be insufficient developer material (toner starvation) in that segment of the bristles contacting that portion of the charge pattern for complete development. This results in defects in the developed image such as washed out areas, or white streaks or spots in the reproduction.

One arrangement for increasing the developer material available for charge pattern development is shown in the Research Disclosure Bulletin of August 1982 at p. 299 (No. 22010). In this arrangement, the nap bristles on an applicator shell are agitated throughout the development zone by counter rotating magnets adjacent to the development zone. Such agitation causes the bristles to rapidly tumble or flip presenting additional developer material to the charge pattern for development. Another arrangement is shown in copending U.S. patent application Ser. No. 474,901 filed Mar. 14, 1983 in the name of W. C. Lu. In this latter arrangement, only a central portion of the nap bristles in the development zone is agitated, with the non-agitated portion forming a curtain about such central portion. Thus, the agitated developer material is sealed from the environs by the non-agitated portion of the nap bristles. While these described arrangements markedly increase the available developer material for effecting charge pattern development, agitation occurs only in the direction of travel of the brush nap on the applicator. This can lead to starvation of developer material of the nap in areas of solid pattern development, while developer material in adjacent transversely spaced areas remain plentiful.

SUMMARY OF THE INVENTION

This invention is directed to a magnetic brush developer apparatus which alleviates any developer material starvation in the area of contact with a charge pattern-bearing member. Such apparatus develops an electrostatic charge pattern on a member by contacting the member with developer material, including magnetic particles, transported toward and away from the charge pattern-bearing member by an applicator member. The transported developer material is magnetically agitated in the area of contact with the charge pattern-bearing member in a direction which includes at least a component perpendicular to the transport direction, whereby intermixing of the developer material in such contact area is substantially improved to reduce any propensity toward toner starvation and the developed image defects resulting from such starvation.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
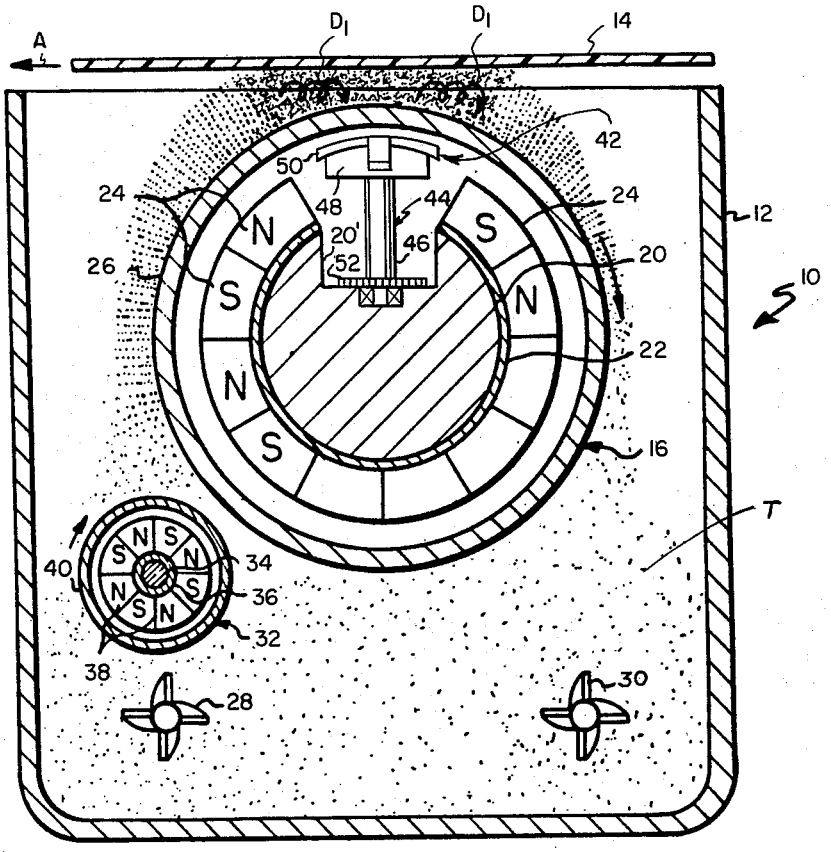
FIG. 1 is an end view, in cross-section, of a magnetic brush developer apparatus including the magnetic agitator according to this invention.
Figure 2:
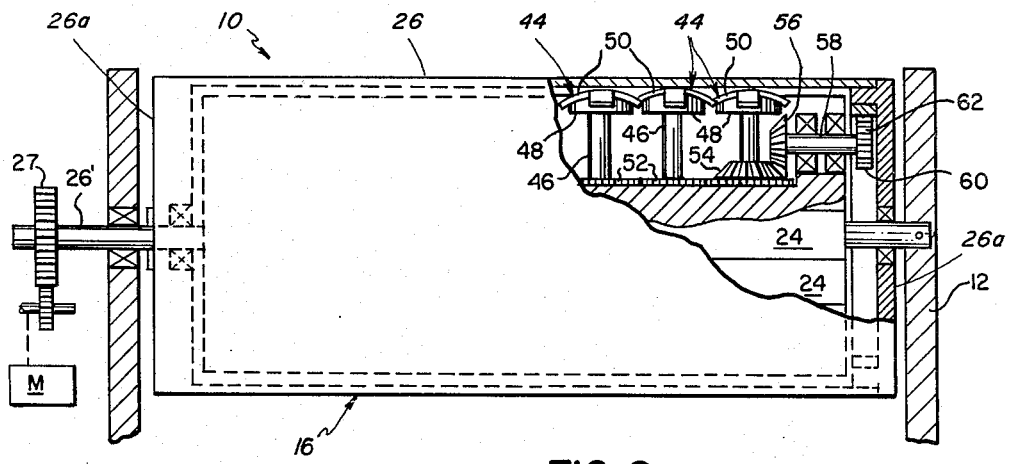
FIG. 2 is a side elevational view of a portion of the magnetic brush developer apparatus of FIG. 1, partly in cross-section and with portions removed to facilitate viewing.

Referring now to the accompanying drawings, a magnetic brush developer apparatus, designated generally by the numeral 10 is best shown in FIGS. 1 and 2. The apparatus 10 includes a housing 12 forming a reservoir for particulate developer material T. The developer material, as discussed above, is either a combination of ferromagnetic carrier particles and toner particles, or single component developer. The housing is located in juxtaposition to, and on one side of, an insulating member 14 capable of retaining electrostatic charge patterns. The member 14, movable in the direction designated by arrow A (see FIG. 1), carries such patterns into pattern developing relation with the apparatus 10. An applicator 16 is mounted in the housing 12 and has a portion located in close proximity to the member 14 for transporting developer material into contact with a charge pattern on such member. Although a single applicator is shown, it is, of course, within the scope of this invention for the apparatus 10 to have any suitable number of applicators.

The applicator 16 includes a stationary substantially cylindrical solid core 20 of non-magnetic material, such as aluminum for example. The longitudinal axis of the core 20 is spaced from the member 14 and extends in a direction perpendicular to the direction of travel of member 14. A stationary magnetic pole piece 22 (providing a magnetic flux path) is adhesively bonded to the core 20. A plurality of permanent magnets 24, of rubber-bonded barium ferrite strips for example, are fixed on a portion of the periphery of the pole piece 22. A shell 26, rotatably mounted in the housing 12 concentrically with the core 20, surrounds the magnet arrangement in the fields of the permanent magnets. The shell is a hollow cylinder or tube of non-magnetic material, such as aluminum, with a roughened peripheral surface. The opposite ends of the shell 26 are provided with end caps 26*a*. A motor M drives a gear 27 mounted on a stub shaft 26' extending from one of the end caps to rotate the shell.

Augers 28 and 30 are rotatably supported in the housing 12 to extend through the developer material T. The augers are rotated, such as by a power takeoff (not shown) from motor M, in order to circulate the developer material in the housing and distribute it along the length of shell 26. When the developer material includes carrier particles and toner particles, such circulation also causes the toner particles to develop a triboelectric charge which results in the adhering of the toner particles to the carrier particles. A feed member 32 transports developer material from the reservoir to the shell 26. The feed member, which is similar in construction to the applicator 16, includes a stationary cylindrical core 34, a pole piece 36, permanent magnets 38 (producing magnetic fields of relatively lesser strength than the magnet fields produced by magnets 24), and a rotatable shell 40 having a roughened surface.

The shell 40 of feed member 32 is operatively coupled to the motor M to rotate such shell. As the shell 40 rotates in the indicated direction, the carrier particles and adhering toner particles (or the single component developer) are held on the roughened peripheral surface of such shell by the magnetic fields of the permanent magnets 38 and are transported to the shell 26. The developer material is transferred from shell 40 to shell 26 by the relatively stronger magnetic fields of the magnets 24 and held on the roughened peripheral surface of shell 26. The particles are established as a brush nap in the form of bristles extending radially from the shell 26 in the fields of the magnets 24. As the shell 26 is rotated by the motor M in the indicated direction, the bristles are moved (in a clockwise direction in FIG. 1) toward and away from the charge pattern bearing member 14.

Figure 4:
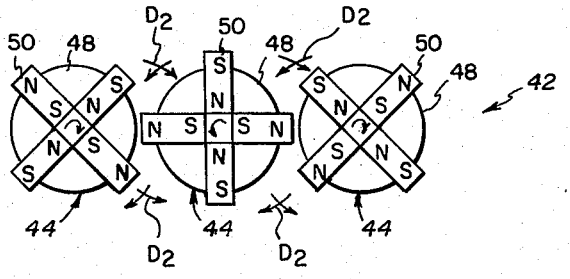
FIG. 4 is a top plan view of a portion of the magnetic brush developer apparatus of FIG. 1, with portions removed to facilitate viewing, showing the transverse component of agitation of developer material.
Figure 3:
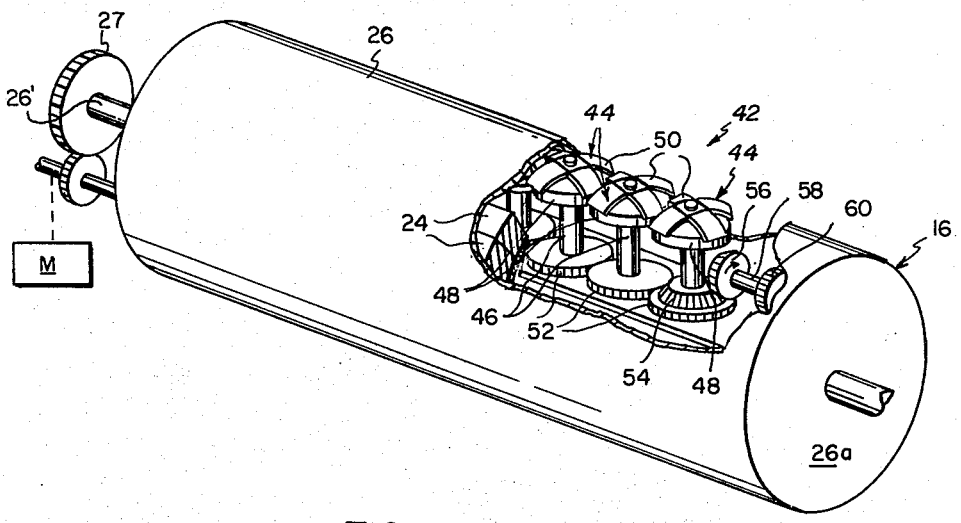
FIG. 3 is an isometric view of a portion of the magnetic brush developer apparatus of FIG. 1, with portions removed to facilitate viewing.

Now, according to the present invention, a magnetic agitator 42 is mounted within an elongated slot 20' formed in the core 20. The slot 20' is parallel to the longitudinal axis of the core and is opposite the area of developing contact between the brush nap on the shell 26 and the member 14. The agitator 42 includes a plurality of rotatable members 44 (see FIGS. 2, 3 and 4). The rotatable members 44 respectively include a non-magnetic upright post 46 rotatably supported at the base of slot 20'. A pole piece 48 (providing a magnetic flux path) is mounted on the upper end of the post and has a plurality of substantially radially extending permanent magnets 50 fixed thereon. The poles of adjacent magnets are of opposite magnetic polarity. The magnets 50 are, for example, in cruciform shape. The respective posts 46 also support gears 52 which intermesh so that adjacent posts rotate in opposite directions.

The rotational drive for the rotatable members 44 is effected by a bevel gear 54 mounted on the post 46 of the right-most member 44 of FIG. 2. The bevel gear 54 is engaged by a bevel gear 56 mounted on one end of a shaft 58 rotatably supported by a portion of the core 20 adjacent to one end of the slot 20'. A pinion 60, mounted on the opposite end of shaft 58, meshes with a ring gear 62 fixed in the interior of shell 26. Therefore, upon actuation of the motor M to rotate the shell 26, the pinion 60 is rotated by the ring gear 62. Rotation of the pinion 60 rotates shaft 58 and bevel gear 56 which, in turn, rotates bevel gear 54 and intermeshing gears 52.

The rotation of the rotatable members 44 and their associated magnets cause a rapid change in the magnetic fields along the longitudinal segment of the shell 26 in the vicinity of the charge pattern-bearing member 14. The bristles of the brush nap of developer material entering this segment are rapidly agitated in such changing fields in a direction which includes components mutually perpendicular to the direction of transport of developer material to such segment. That is, the developer material is agitated in the direction radially of the shell 26 (indicated by arrows $D_1$ in FIG. 1) and substantially parallel to the longitudinal axis of the shell (indicated by arrows $D_2$ in FIG. 4). During such agitation the developer material making up the bristles rapidly flips end-for-end and also moves along the surface of the shell parallel to the shell's longitudinal axis for increased intermixing of the constituent particles over that found in prior developer apparatus. As a result a greater portion of the developer material (including particularly the toner particles) is brought into contact with the member 14. Therefore, a relatively increased amount of developer material is presented to the charge pattern on the member 14 for improved development of such charge pattern. Moreover, the movement of the developer material along the shell surface substantially assures that no area of the brush becomes starved of developer material in such segment over which development is to take place, accordingly reducing any image defects which would result from such starvation.

The invention has been described in detail with particular reference to a preferred embodiment thereof, but it will be understood that variations and modifications can be effected within the spirit and scope of the invention.

I claim:

1. In magnetic brush developer apparatus for developing an electrostatic charge pattern on a member with developer material including magnetic particles, said apparatus including applicator means for transporting such developer material toward and away from said charge pattern-bearing member, the improvement comprising:

magnetic means, operatively associated with said applicator means, for agitating said developer material transported by said applicator in at least a direction which includes a component substantially perpendicular to the direction of transport and parallel to said applicator means, whereby such agitation increases the developer material contacting said charge pattern-bearing member to develop such charge pattern with such material thus reducing material starvation along such applicator means in the contact area.

2. The invention of claim 1 wherein said magnetic means includes a plurality of magnet members mounted in said applicator means for rotation about a plurality of parallel axes respectively, said axes being spaced from one another and substantially lying in a plane perpendicularly intersecting the charge pattern-bearing member, and means for rotating said magnet members.

3. The invention of claim 2 wherein said plurality of magnet members include a plurality of elongated non-magnetic posts extending along said plurality of axes respectively, said posts respectively supporting plurality of magnets, with adjacent poles being of opposite polarity, for rotation about the axis of such post.

4. Method for developing an electrostatic charge pattern on a member with developer material including magnetic particles said method comprising the steps of:

forming a brush nap of developer material;

transporting such brush nap toward and away from a development zone in contact with such charge pattern bearing member; and agitating developer material in such development zone in a direction which includes at least a component substantially perpendicular to the direction of transport and parallel to such charge pattern-bearing member, whereby such agitation increases the developer material contacting such charge pattern-bearing member to develop charge pattern with such material thus reducing material starvation in any area of such development zone.

5. The invention of claim 4 wherein in the step of agitating such developer material, such agitation is in a direction which includes a plurality of components substantially mutually perpendicular to the direction of transport.

* * * * *